US009855576B2

(12) United States Patent
Bach et al.

(10) Patent No.: US 9,855,576 B2
(45) Date of Patent: Jan. 2, 2018

(54) PAINT MASKING SYSTEM AND METHOD

(71) Applicant: Honda Motor Co., Ltd., Tokyo (JP)

(72) Inventors: Edward W Bach, Galloway, OH (US); Masahiro Ishikawa, Dublin, OH (US); Christos Agouridis, Jr., Dublin, OH (US); Joseph M Riggsby, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 44 days.

(21) Appl. No.: 14/830,058

(22) Filed: Aug. 19, 2015

(65) Prior Publication Data

US 2017/0050205 A1 Feb. 23, 2017

(51) Int. Cl.
*B05B 15/04* (2006.01)

(52) U.S. Cl.
CPC ..... *B05B 15/045* (2013.01)

(58) Field of Classification Search
CPC ..... B05B 15/045; B05B 15/0456; B05B 15/0462; B05B 15/04; B05B 15/06; Y10T 428/24347; Y10T 428/24339; B32B 25/00
USPC ..... 427/282
See application file for complete search history.

(56) References Cited

U.S. PATENT DOCUMENTS

| | | | | |
|---|---|---|---|---|
| 2,324,568 | A | 7/1943 | Duggan | |
| 3,776,180 | A | 12/1973 | Rich | |
| 4,676,193 | A | 6/1987 | Martin | |
| 4,759,959 | A | 7/1988 | Guy | |
| 5,989,637 | A | 11/1999 | Rizzo et al. | |
| 6,280,821 | B1 | 8/2001 | Kadunce et al. | |
| 6,440,219 | B1 | 8/2002 | Nguyen | |
| 6,641,672 | B2 | 11/2003 | Nguyen | |
| 6,645,299 | B2 | 11/2003 | Brown | |
| 6,844,527 | B2 | 1/2005 | Nguyen | |
| 7,247,366 | B2 * | 7/2007 | Ogawa | B05B 15/045 428/174 |
| 2008/0118656 | A1 * | 5/2008 | Douglas | B05B 15/0468 427/444 |
| 2009/0304931 | A1 | 12/2009 | Uenosono | |
| 2011/0031782 | A1 * | 2/2011 | Disse | B62D 25/06 296/216.09 |
| 2014/0158046 | A1 | 6/2014 | Kim | |

FOREIGN PATENT DOCUMENTS

| | | | | |
|---|---|---|---|---|
| DE | 202006007182 U1 * | 4/2006 | ..... | B05C 17/06 |

OTHER PUBLICATIONS

DE 202006007182U1 Machine Translation of Description.*

* cited by examiner

*Primary Examiner* — Michael N Orlando
*Assistant Examiner* — Cynthia Schaller
(74) *Attorney, Agent, or Firm* — Honda Patents & Technologies North America, LLC; Mark E. Duell

(57) ABSTRACT

A masking system and method for painting a vehicle with parts made of dissimilar materials is provided. The masking system includes a masking gasket temporarily mounted between a mounting surface of a first part and a mounting surface of a second part. The masking gasket further includes a plurality of links, thermal expansion joints linking together the plurality of links, and mounting locations for securing the masking gasket to the first and second parts of the vehicle.

14 Claims, 9 Drawing Sheets

PAINT MASKING SYSTEM AND METHOD

BACKGROUND

The subject matter disclosed herein relates generally to methods of assembling materials made of varying materials. More particularly, the subject matter disclosed herein relates to a system and method for assembling a roof to a vehicle body for the purpose of painting the vehicle body and roof together.

Methods of attachment of roof panels to a vehicle body structure using various methods are known. Using continuous welding can offer certain advantages over traditional two-sided resistance spot welds. Adhesive has been used for roof panel attachment. For example, aluminum roofs often replace the standard steel roof panel as a method of weight reduction. Typically, such adhesives may be cured at room temperature, such as polyurethane, epoxy and acrylic adhesives.

However, due to aluminum and steel having differing expansion rates, final attachment of an aluminum roof to a steel body must occur after all heat intensive processes, such as painting, have occurred. The substitution of aluminum or aluminum-based alloy roof panels for the low-carbon steel or steel alloy roof panels most commonly used in motor vehicles is an attractive option for vehicle mass reduction. Often, however, the remainder of the vehicle body structure continues to be fabricated of steel. Joining an aluminum roof panel to a steel body panel is difficult due to the thermal expansion considerations of the dissimilar materials. The combination of the aluminum roof panel attached to the steel body may create compressive stresses in the aluminum roof panel when the body is subjected to elevated temperatures such as those required to cure or bake the paint applied to the body. These stresses may lead to unacceptable appearance features in the visible segment of the roof panel. The roof panel is positioned on the vehicle on the assembly line using temporary stand-off fixtures. The gap these stands-off create allow for e-coat and paint coverage. The body color roof panel is then removed from the stand-offs in trim and final and bonded on using a low modulus, one or two component polyurethane adhesive. Induction heating may be incorporated into the robotic handling fixture to accelerate the cure rate. Alternatively hot air impingement heating may be used to accelerate the cure of the adhesive.

Manufacturers currently secure the aluminum roof panel to the steel body panel after the weld process in assembly. This process typically includes an adhesive bonding operation. Self-piercing rivets can also be used to secure the aluminum roof panel to the steel body panel. This approach, though appealing from a vehicle mass-reduction viewpoint, raises issues due to the significantly different coefficients of thermal expansion of aluminum and steel (about 22.5.times.10.sup.-6 m/m K for aluminum and about 13.times.10.sup.-6 m/m K for steel). The adhesive must be able to absorb the distortion caused by the thermal expansion difference between the roof panel and the steel body panel. Further, because the steel and aluminum are permanently joined together by the rivets, this difference in thermal expansion of steel and aluminum will develop stresses in the aluminum and steel whenever the vehicle body temperature differs from the temperature at which the joint was made. The highest temperature experienced by the vehicle body is during manufacture when the assembled body is painted. Automotive paint consists of a number of layers, applied separately and then cured at elevated temperature. The paint is cured by passing the painted body through one or more paint bake ovens to raise the body temperature to about 180-200° C. and maintain it at that temperature for at least 20 minutes. This elevated temperature may be sufficient to initiate plastic deformation in the aluminum roof panel. Since plastic deformation is not reversed on cooling, any such deformation may result in an appearance feature such as a crease or buckle in the roof panel which would be unacceptable to the customer.

Further, having the roof and vehicle body panels in contact or electrically connected can create galvanic corrosion. The risk for this corrosion is increased when water is present, such as in the roof gutter areas. As it relates to the adhesive, the current joining process uses the paint bake ovens to cure the adhesive bonding the aluminum roof panel to the steel body panel. However, the heat from the paint bake ovens can cause distortion of the aluminum roof panel relative to the steel body, creating a bowing effect. If left unconstrained, the roof panel would bow enough to break the adhesive bond between the roof panel and vehicle body.

In order to achieve good bonding strength between a roof panel and body the bonding surfaces need to be fully painted or bare electrodeposition (ED) coat. To achieve a fully painted condition the paint robots must have an optimal distance from the body and an optimal angle relative to the body. When trying to paint the body and roof at the same time it becomes difficult to guarantee full paint coverage or bare ED coating. The full paint coverage is difficult because the roof bond flange block the side panel outer bond flange. The roof panel needs offset above the body to make the side panel outer bond flange visible. When offsetting the roof panel above the body the ceiling of the paint line becomes the limit as to how far the roof panel can be offset. With the limit of the ceiling being considered the bottom of the roof cannot be painted because the distance from the body and the optimal paint angle to the body cannot be achieved. When painting the side panel outer with the ceiling limitation parts of the side panel outer weld flange are not within the optimal painting angle. Due to the ceiling limitation the bond area on the roof and side panel outer flanges cannot be fully painted. Applying a tape masking to the top of the roof panel is difficult due to the cut outs and studs that are applied to the Roof panel and side panel. Due to the 5.0 mm nominal gap between the roof panel and the side panel outer just taping the top of the roof panel does not prevent paint overspray from inside the vehicle from getting on the bonding flanges of the side panel outer and roof panel. One other option is to place the roof panel directly on the side panel outer. When placing the roof panel on the side panel outer the tolerance's need to be considered to determine the maximum possible gap. The maximum possible gap with tolerance is 2.0 mm. When applying a 2.0 mm gap between the side panel outer and the roof panel there is still some overspray from the outside and inside of the vehicle on the bonding surfaces of the roof and side panel outer. The only way to prevent any overspray is to apply something between the roof panel and the side panel outer.

The existing masking options are not able to eliminate paint overspray from getting on the bonding surfaces of the roof panel and the side panel outer. Tape masking is difficult to install with studs and varying trims where the injection molded masking can be formed to the part shape. The injection molded masking can use the studs and holes on the body to locate the parts in the correct position and to reduce install time. Trying to prevent paint overspray on the bonding surfaces of the side panel outer and the roof panel with a touch condition is effected by part tolerances so the gap is 0.0-2.0 mm. With the injection molded masking the part tolerances are accounted for because the roof panel is bolted to the body with the masking in between pulling all three parts tight. The lips on the inside and the outside of the masking accommodate any additional tolerance and part variations.

APPLICATION SUMMARY

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

The injection molded masking prevents any paint overspray on the adhesive surface of the roof and the side panel outer. Since there is a contact between the masking and the adhesive surfaces there is no gap for the paint overspray to penetrate the masking. The lips on the outside and on the inside absorb surface tolerance accounting for part variation. The masking is repeatedly placed to the body using datum holes and mounting studs to prevent miss assembly. By using the injection molded masking full ED coating can be guaranteed on the adhesive bonding surfaces even after the rest of the vehicle is painted.

According to one aspect, a masking system for painting a vehicle with a first part made of a first material and a second part made of a second material is provided. The masking system includes a masking gasket temporarily mounted between a first mounting surface of the first part and a second mounting surface of the second part. The masking gasket further includes a plurality of links, thermal expansion joints linking together the plurality of links, and mounting locations for securing the masking gasket to the first and second parts of the vehicle.

According to another aspect, a method of painting a vehicle having a first part made of a first material and a second part made of a second material during production is provided. The method includes the steps of mounting a masking gasket between a first mounting surface of the first part and a second mounting surface of the second part, the masking gasket having a plurality of links, thermal expansion joints linking together the plurality of links, and mounting locations for securing the masking gasket to the first and second parts of the vehicle. The second part is aligned to the masking gasket and the first part by aligning the mounting locations with a plurality of studs and holes in the first and second parts. The second part is mounted to the masking gasket and the first part. The method further includes the steps of painting the vehicle with paint, heating the vehicle in an oven to cure the paint, unmounting the second part from the vehicle, removing the masking gasket, and securably mounting the second part to the first part.

The figures depict various embodiments of the embodiments for purposes of illustration only. One skilled in the art will readily recognize from the following discussion that alternative embodiments of the structures and methods illustrated herein may be employed without departing from the principles of the embodiments described herein.

DETAILED DESCRIPTION

Figure 1A:
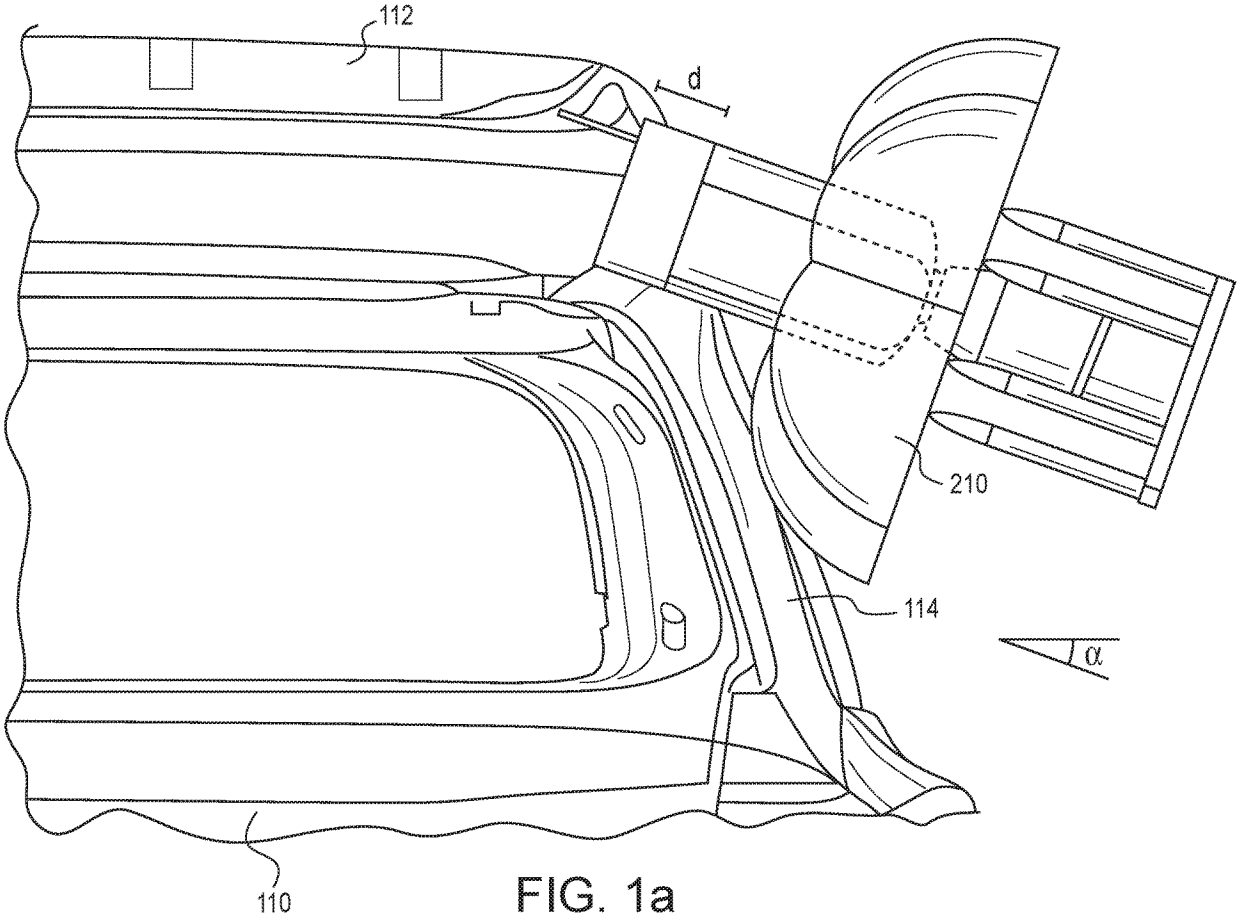
FIG. 1a PRIOR ART
FIG. 1*a* is a view of a portion of a vehicle body showing a roof panel and side panel outer, and an illustration of a paint robot.
Figure 1B:
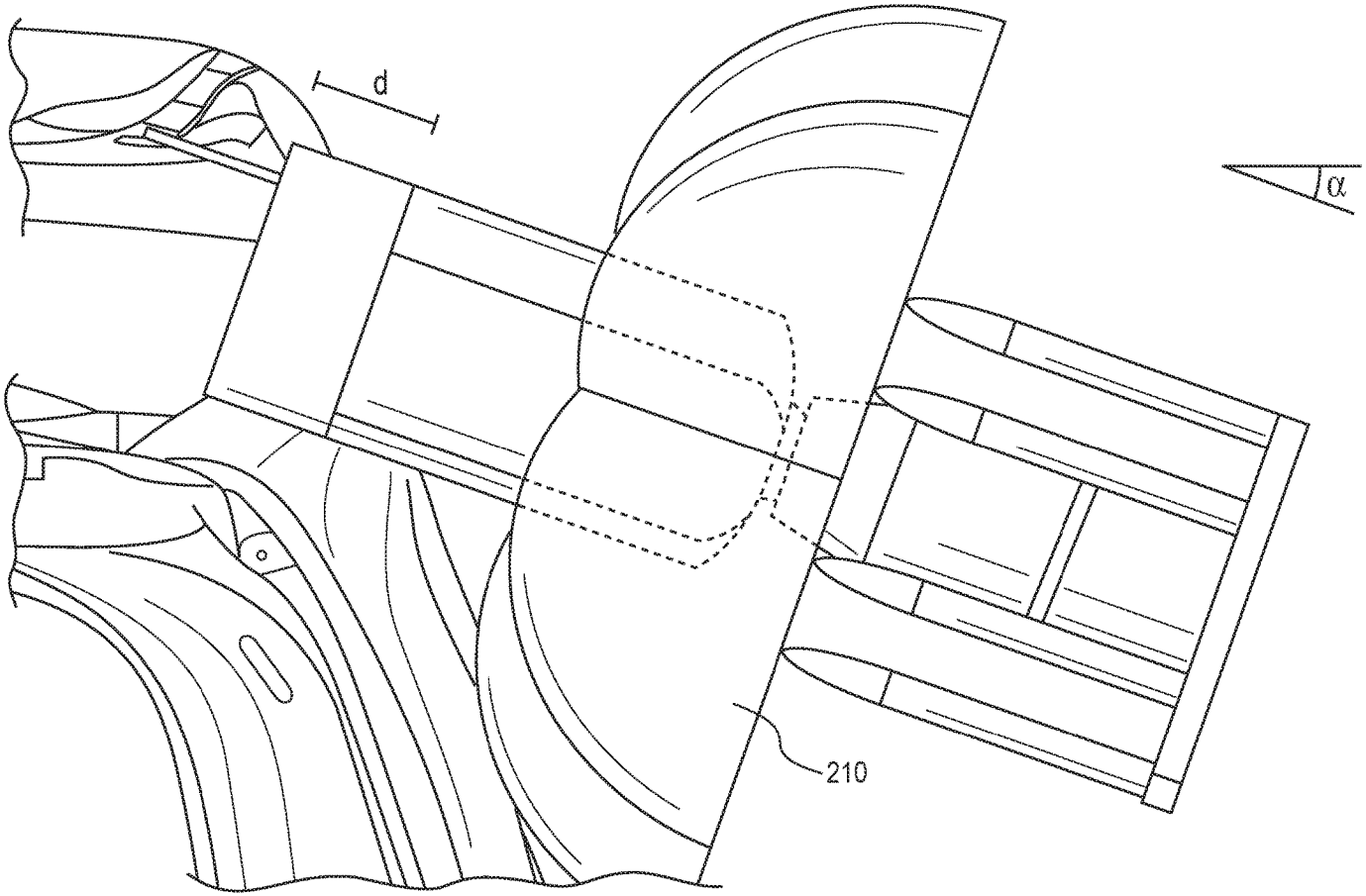
FIG. 1b PRIOR ART
FIG. 1*b* is a close up view of the vehicle body and paint robot of FIG. 1*a;*
Figure 2A:
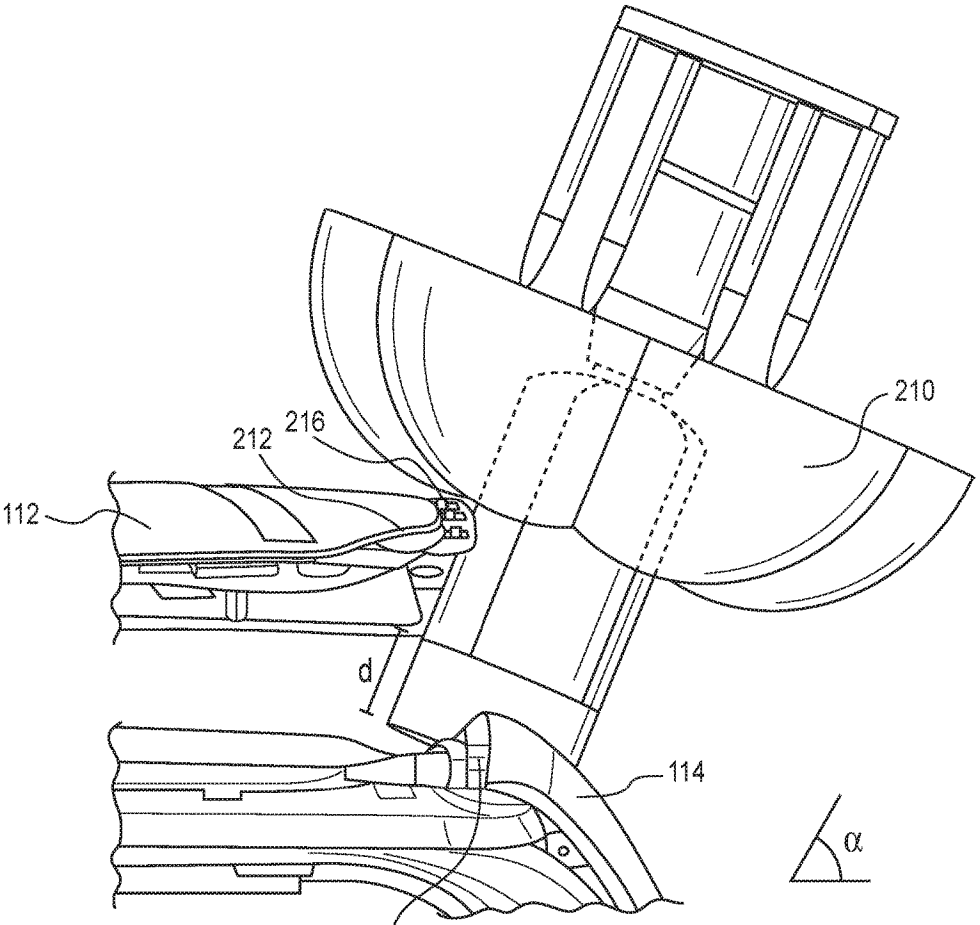
FIG. 2a PRIOR ART
FIG. 2*a* is a view of a portion of a vehicle body showing a roof panel and side panel outer, and an illustration of a paint robot.
Figure 2B:
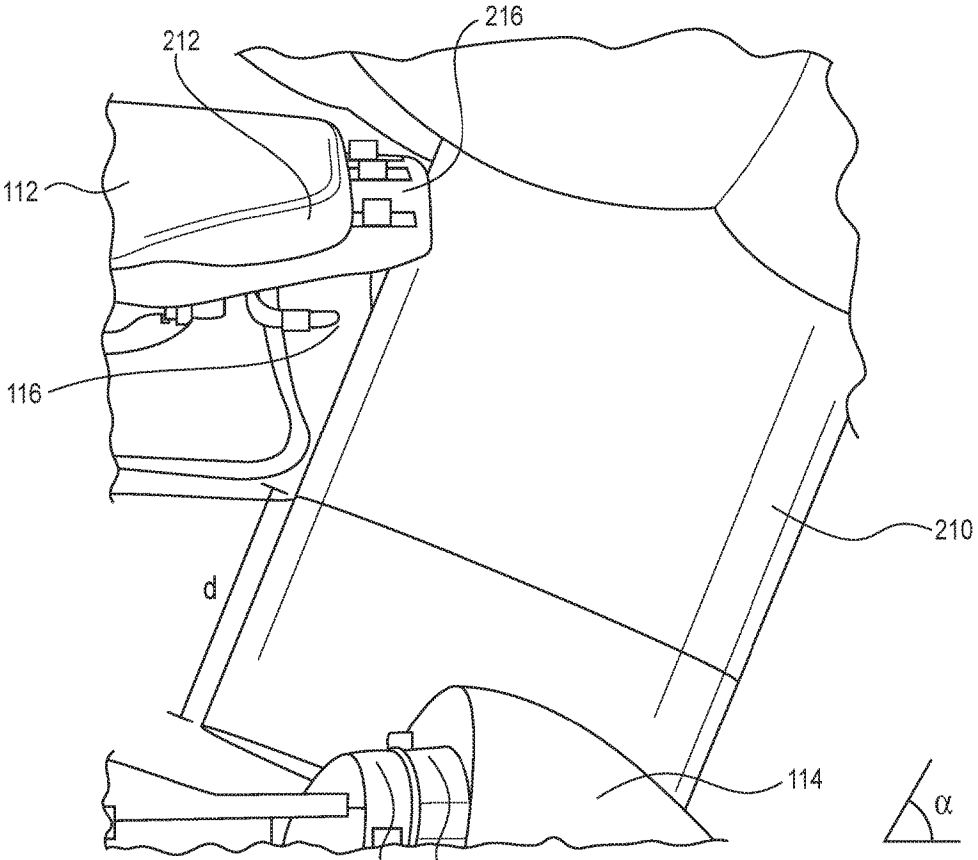
FIG. 2b PRIOR ART
FIG. 2*b* is a close up view of the vehicle body and paint robot of FIG. 2*a;*
Figure 3:
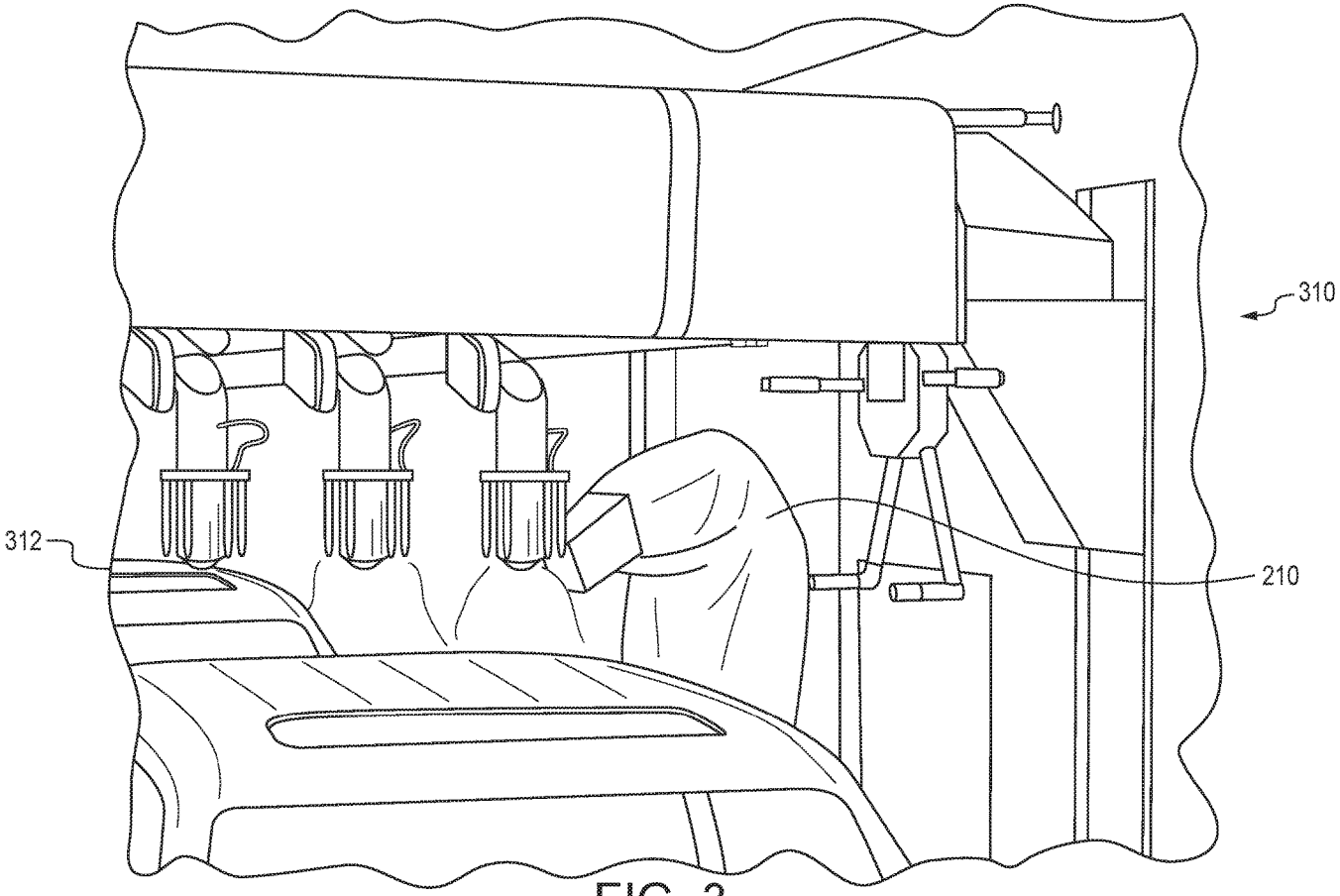
FIG. 3 PRIOR ART
FIG. 3 is a view of a vehicle body in the paint station of a vehicle assembly line.
Figure 4:
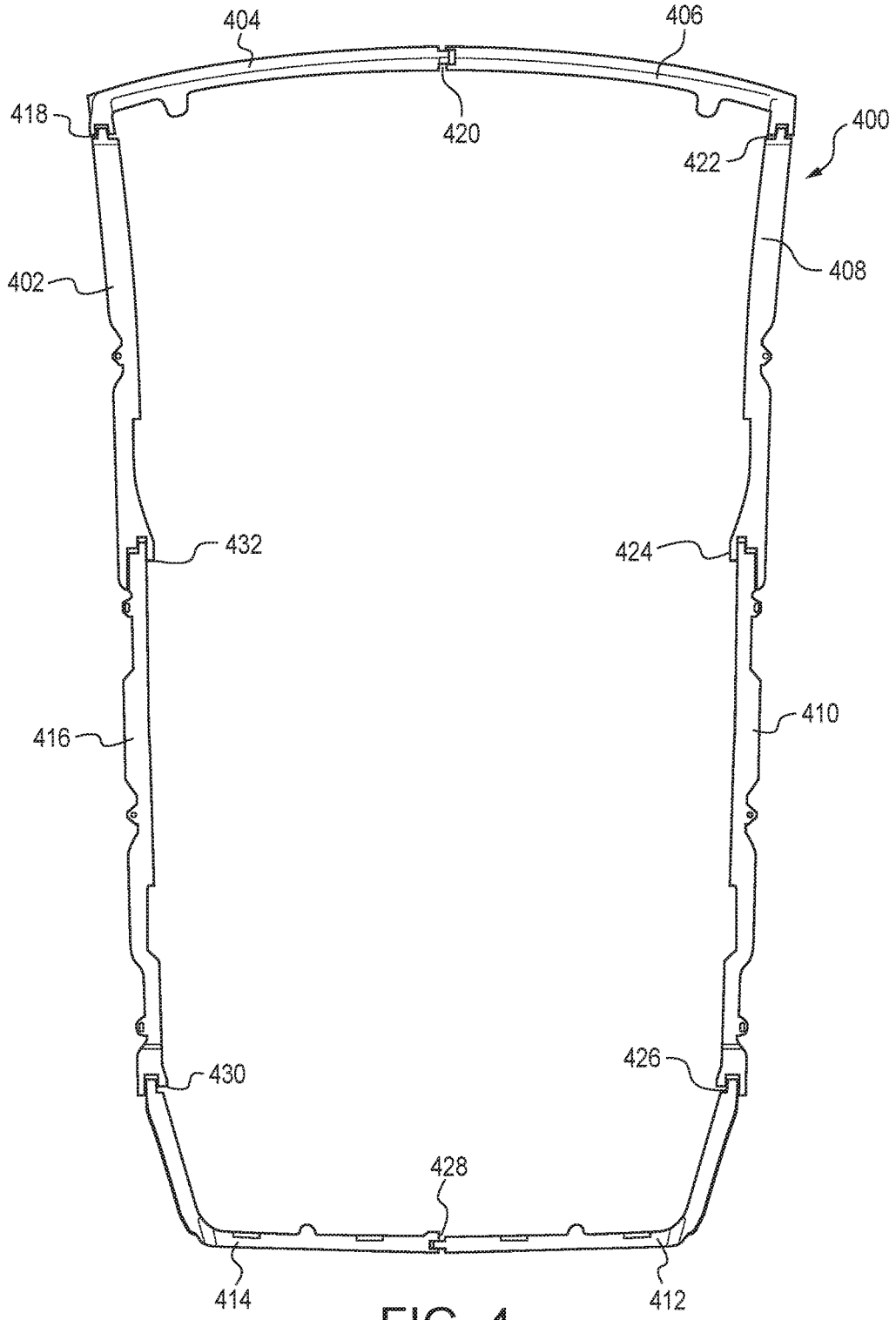
FIG. 4 is a view of an embodiment of a paint masking system.

As shown in FIGS. 1*a*, 1*b*, 2*a*, and 2*b*, in order to achieve good bonding strength between a roof panel 112 and side panel outer 114 of a vehicle body 110, the bonding surfaces 116, 118 need to be fully painted or coated with a bare electrophoretic deposition (ED) coat. To achieve a fully painted condition the paint robot 210 of an assembly line should have a distance d from the body 110 and an angle $\alpha$ relative to the body 110 that allows all of the parts to be painted without causing spike faults or sparks. When trying to paint the side panel outer 114 and roof panel 112 at the same time it becomes difficult to guarantee full paint coverage or bare ED coating. The full paint coverage is difficult because the roof bond flange 212 blocks the side panel outer bond flange 214. The roof panel 112 needs to be offset above the vehicle body 110 to make the side panel outer bond flange 214 visible. When offsetting the roof panel 112 above the vehicle body 110 the ceiling 312 of the paint line 310, as shown in FIG. 3, becomes the limit as to how far the roof panel 112 can be offset. With the limit of the ceiling 312 being considered, the bottom 216 of the roof panel 112 cannot be painted because the distance d from the vehicle body 110 and the paint angle $\alpha$ to the vehicle body 110 necessary for complete paint coverage cannot be achieved. When painting the side panel outer 114 with the ceiling 312 limitation parts of the side panel outer weld flange 214 are not within the painting angle $\alpha$ required for complete paint. Due to the ceiling 312 limitation the bond area on the roof bond flange 212 and the side panel outer flange 214 cannot be fully painted. Applying a tape masking to the top of the roof panel 112 is difficult due to the cut outs 216 and studs (not shown) that are applied to the roof panel 112 and side panel outer 114. Due to the 5.0 mm nominal gap between the roof panel 112 and the side panel 114 outer just taping the top of the roof panel 112 does not prevent paint overspray from inside the vehicle from getting on the bonding flanges 212, 214 of the side panel outer 114 and roof panel 112. One other option is to place the roof panel 112 directly on the side panel outer 114. When placing the roof panel 112 on the side panel outer 114, the tolerance needs to be considered to determine the maximum possible gap. The maximum possible gap with tolerance is 2.0 mm. When applying a 2.0 mm gap between the side panel outer 114 and the roof panel 112, there is still some overspray from the outside and inside of the vehicle body 110 on the bonding surfaces 116, 118 of the roof panel 112 and side panel outer 114. The only way to prevent any overspray is to apply something between the roof panel 112 and the side panel outer 114.

ED coating is well known in automotive and other vehicle manufacturing industries and, therefore, need not be described in detail herein. Basically, however, an electrically charged material (e-coat material) is coated to a vehicle body by imparting the vehicle body with a DC electrical charge that is opposite to that of a DC electrical charge imparted to the e-coat material. Consequently, when the vehicle and e-coat material are placed into contact (or near contact, in some cases), the e-coat material is attracted to and deposits on the oppositely-charged vehicle body. Such e-coat materials are generally applied to a vehicle body prior to primers (if used) and paints (often referred to as "white body" stage) to provide the vehicle body with improved corrosion resistance.

According to an embodiment shown in the FIGS. 4-7, injection molded masking gasket 400 prevents any paint overspray on the adhesive surface 116, 118 of the roof panel 112 and the side panel outer 114. Since there is a contact between the masking gasket 400 and the adhesive surfaces 116, 118, there is no gap for the paint overspray to penetrate the masking gasket 400. The ribs 500 on the outside 502 and on the inside 504 of the masking gasket 400 absorb surface tolerance accounting for variations in the roof panel 112 and the side panel outer 114. The masking gasket 400 is repeatedly placed on the vehicle body 110 using datum holes 512 and mounting studs 514 to prevent missassembly. By using the injection molded masking gasket 400, full ED coating can be guaranteed on the adhesive bonding surfaces 116, 118 even after the rest of the vehicle body 110 is painted.

As shown in the figures, the masking gasket 400 is assembled from a series of parts 402, 404, 406, 408, 410, 412, 414, 416. While the embodiment of the masking gasket 400 illustrated in the figures includes eight parts 402, 404, 406, 408, 410, 412, 414, 416, the masking gasket 400 may include more or fewer parts depending on the relative sizes of the roof panel 112 and side panel outer 114 to be connected. Further, nothing in this description of the embodiment shown in the figures should be construed to limit the use of masking gasket 400 described herein to the specific parts described.

With continuing reference to the figures, the embodiment shows a masking gasket 400 with eight injection molded links 402, 404, 406, 408, 410, 412, 414, 416. The links 402, 404, 406, 408, 410, 412, 414, 416 may be made of any suitable material capable of being injection molded while maintaining structural integrity while subjected to the heat of the paint bake ovens of 160° C. The material is preferably Nylon 6, otherwise known as poly(hexano-6-lactam) or polycaprolactam, with 35% mineral additive, though any other suitable material known to one skilled in the art may be used. Nylon 6 may also be known under the trade names Perlon, Nylatron, Capron, Ultramid, Akulon, Kapron, and Durethan.

Figure 5:
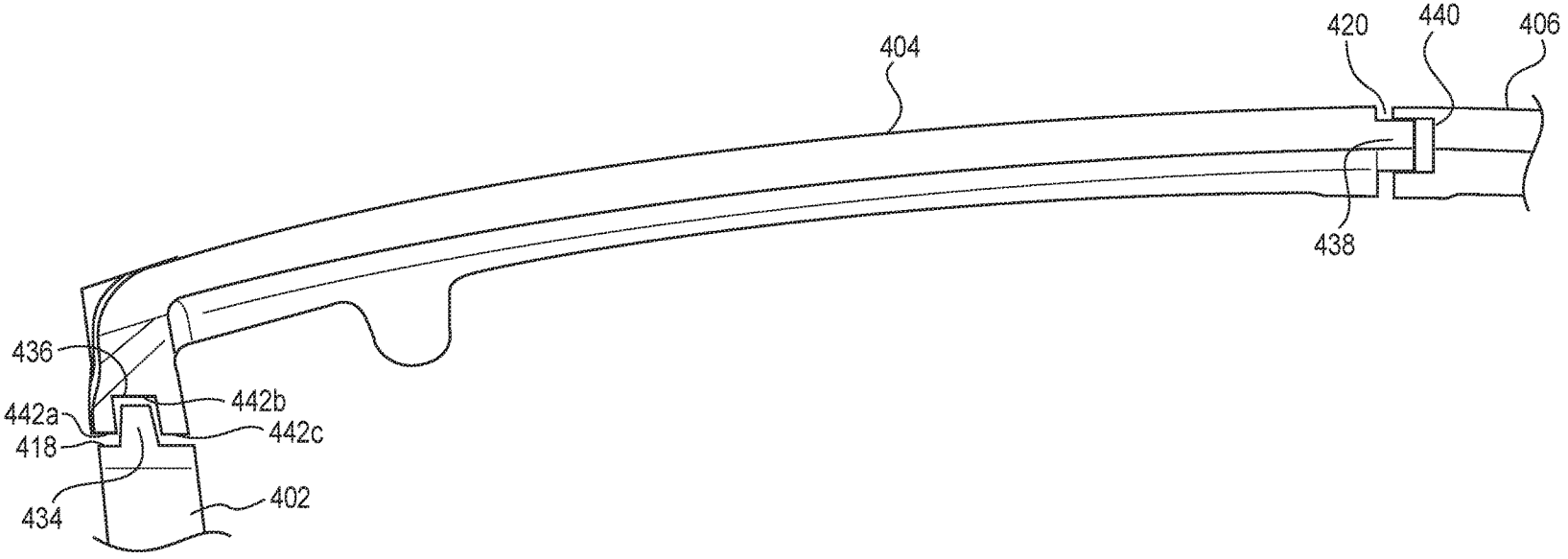
FIG. 5 is a view of an embodiment of a portion of a paint masking system.

As shown in figures, each of the links 402, 404, 406, 408, 410, 412, 414, 416 has a thermal expansion joint 418, 420, 422, 424, 426, 428, 430, 432 at each end. As shown in FIG. 5, for example, thermal expansion joint 418 is created by a male end 434 of link 402 fitting into a female end 436 of adjacent link 404, and thermal expansion joint 420 is created by a male end 438 of link 404 that fits into the female end 440 of the adjacent link 406. The space 442*a*, 442*b*, 442*c* in the thermal expansion joint 418, for example, provides sufficient room for the masking gasket 400 to expand with the thermal expansion of the roof panel 112 and side panel outer 114 during the baking process in the ovens (not shown) because thermal expansion of the masking gasket 400 is greater than that of the roof panel 112 and side panel outer 114.

The masking gasket 400 also includes datum holes 502 for mounting the masking gasket 400 to the side panel outer 114 of the vehicle body 110. The masking gasket 400 may also include studs 514 to fit into datum holes (not shown) in the roof panel 112. Both the datum holes 512 and studs 514 allow for the masking gasket 400 to be mechanically secured in place during the attachment of the roof panel 112 to the side panel outer 114, thereby ensuring proper placement of the masking gasket 400.

Figure 6:
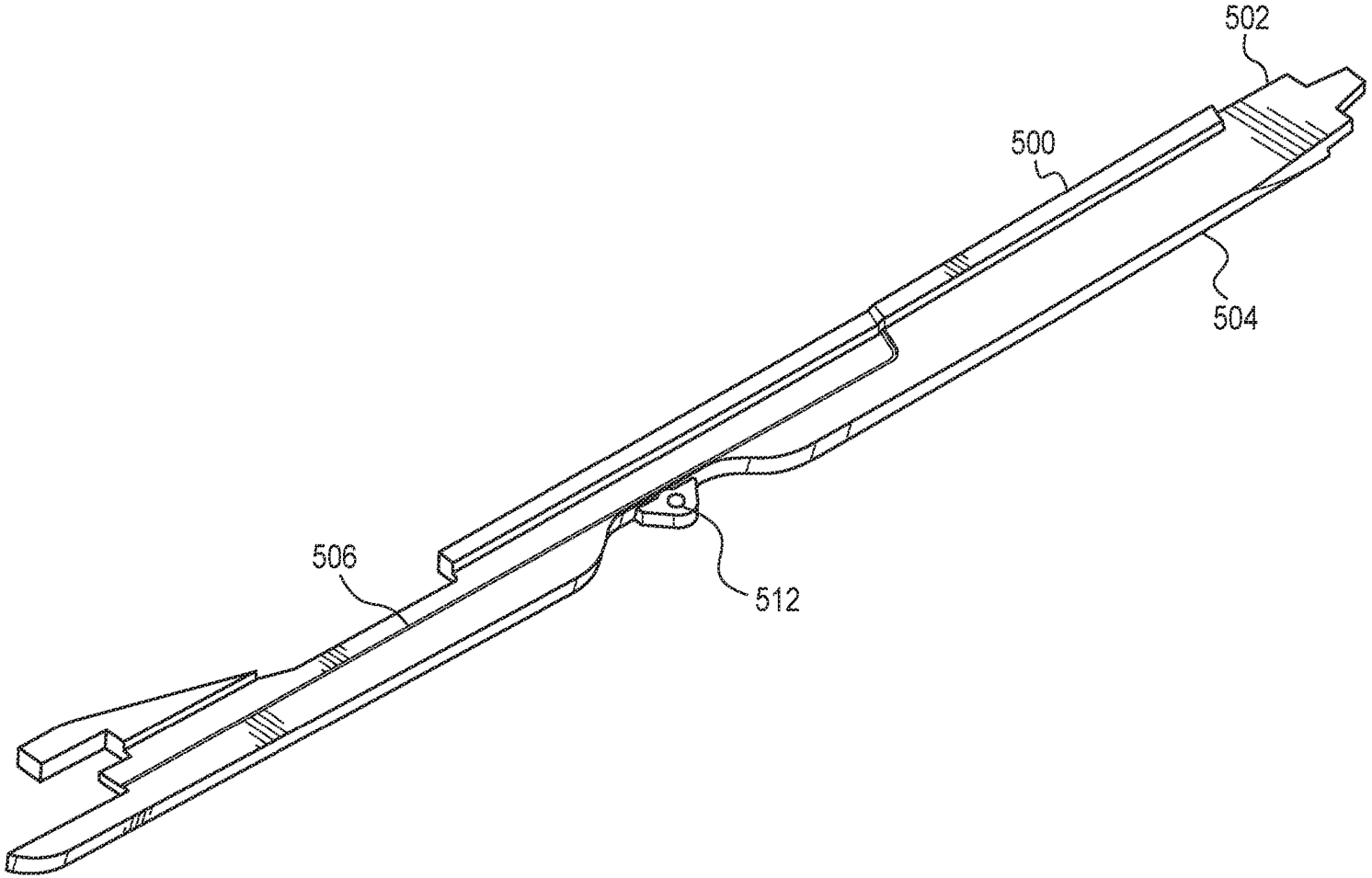
FIG. 6 is a view of an embodiment of a portion of a paint masking system.
Figure 7:
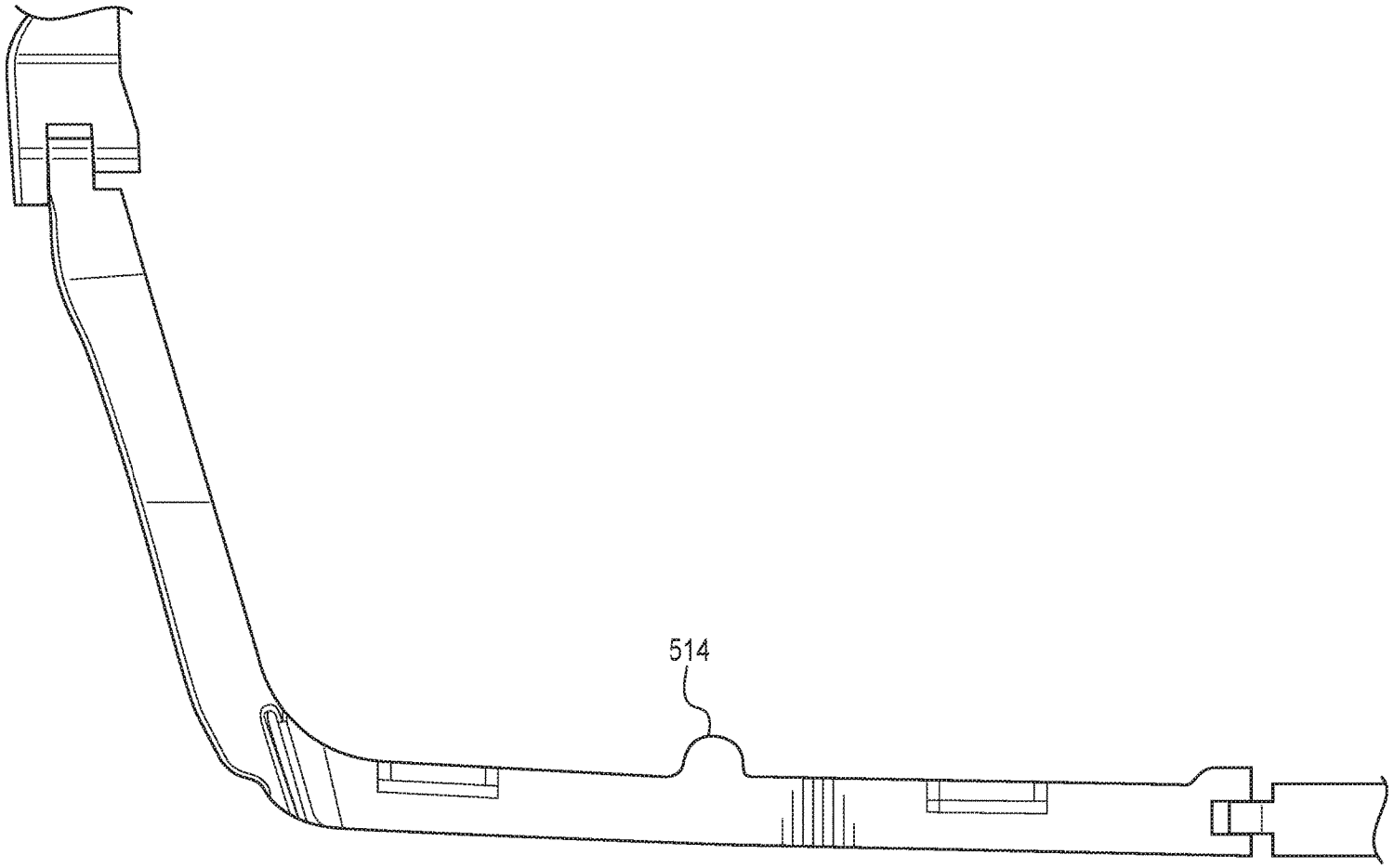
FIG. 7 is a view of an embodiment of a portion of a paint masking system.

With further reference to the embodiment shown in the figures, the masking gasket 400 may also include a joggle 506 or ribs 500 to ensure a proper fit between the side panel outer 114 and the roof panel 112. As shown in FIG. 6, the masking gasket 400 is configured to match the shape and contours of the side panel outer 114 and roof panel 112 of the vehicle body 110. The joggle 506 may allow for clearance to the side panel outer 114 and roof panel 112. Ribs 500 may absorb variations in the side outer panel 114 or roof panel 112 to ensure proper sealing of the parts by the masking gasket 400.

Reference in the specification to "one embodiment" or to "an embodiment" means that a particular feature, structure, or characteristic described in connection with the embodiments is included in at least one embodiment. The appearances of the phrase "in one embodiment" or "an embodiment" in various places in the specification are not necessarily all referring to the same embodiment.

In addition, the language used in the specification has been principally selected for readability and instructional purposes, and may not have been selected to delineate or circumscribe the inventive subject matter. Accordingly, the disclosure of the embodiments is intended to be illustrative, but not limiting, of the scope of the embodiments, which is set forth in the claims.

While particular embodiments and applications have been illustrated and described herein, it is to be understood that the embodiments are not limited to the precise construction and components disclosed herein and that various modifications, changes, and variations may be made in the arrangement, operation, and details of the methods and apparatuses of the embodiments without departing from the spirit and scope of the embodiments as defined in the appended claims.

What is claimed is:

1. A masking system for painting a vehicle with a vehicle roof panel made of a first material and an outer side panel made of a second material, comprising:

a masking gasket temporarily mounted between a first mounting surface of the vehicle roof panel and a second mounting surface of the outer side panel, further comprising:

a plurality of links, each of the plurality of links having a male end and a female end;

thermal expansion joints linking together the plurality of links formed by the male end of each of the plurality of links attached to the female end of an adjacent one of the plurality of links, the plurality of links forming a closed chain; and mounting locations for securing the masking gasket to the vehicle roof panel and the outer side panel of the vehicle.

2. The masking system of claim 1 wherein the first material comprises aluminum and the second material comprises steel.

3. The masking system of claim 1 wherein the thermal expansion joints are configured to accommodate the expansion rates of the first and second materials and the masking gasket when the vehicle is heated during a painting process.

4. The masking system of claim 1 wherein the links are shaped so that a first side is contoured to match the first mounting surface of the vehicle roof panel and that a second side is contoured to match the second mounting surface of the outer side panel.

5. The masking system of claim 4 wherein at least one of the plurality of links further comprise at least one rib along at least one of the first or second sides to absorb a tolerance in the vehicle roof panel or the outer side panel.

6. The masking system of claim 1 wherein the mounting locations of the masking gasket correspond to studs and holes in the vehicle roof panel and the outer side panel to securely attach the masking gasket between the vehicle roof panel and the outer side panel of the vehicle.

7. The masking system of claim 1 wherein the masking gasket is injection molded plastic.

8. A method of painting a vehicle having a first part made of a first material and a second part made of a second material during production, comprising the steps of:

mounting a masking gasket between a first mounting surface of the first part and a second mounting surface of the second part, the masking gasket having a plurality of links, each of the plurality of links having a male end and a female end, thermal expansion joints linking together the plurality of links formed by the male end of each of the plurality of links attached to the female end of an adjacent one of the plurality of links, the plurality of links forming a closed chain, and mounting locations for securing the masking gasket to the first and second parts of the vehicle;

aligning the second part to the masking gasket and the first part by aligning the mounting locations with a plurality of studs and holes in the first and second parts;

securably mounting the second part, the masking gasket and the first part together;

painting the vehicle with paint;

heating the vehicle in an oven to cure the paint;

unmounting the second part from the vehicle;

removing the masking gasket; and securably mounting the second part to the first part.

9. A masking system for painting a vehicle with a first part made of a first material and a second part made of a second material, comprising:

a masking gasket temporarily mounted between a first mounting surface of the first part and a second mounting surface of the second part, further comprising:

a plurality of links, each of the plurality of links having a male end and a female end, each of the plurality of links being shaped so that a first side is contoured to match the first mounting surface of the first part and that a second side is contoured to match the second mounting surface of the second part, and at least one of the plurality of links further comprises at least one rib along at least one of the first or second sides to absorb a tolerance in the first or second part;

thermal expansion joints linking together the plurality of links formed by the male end of each of the plurality of links attached to the female end of an adjacent one of the plurality of links, the plurality of links forming a closed chain; and mounting locations for securing the masking gasket to the first and second parts of the vehicle.

10. The masking system of claim 9 wherein the mounting locations of the masking gasket correspond to studs and holes in the first and second parts to securely attach the masking gasket between the first and second parts of the vehicle.

11. The masking system of claim 9 wherein the masking gasket is injection molded plastic.

12. The masking system of claim 9 wherein the first part comprises a vehicle roof panel and the second part comprises an outer side panel adjacent the vehicle roof panel.

13. The masking system of claim 9 wherein the first material comprises aluminum and the second material comprises steel.

14. The masking system of claim 9 wherein the thermal expansion joints are configured to accommodate the expansion rates of the first and second materials and the masking gasket when the vehicle is heated during a painting process.

* * * * *